US009221636B2

(12) United States Patent
Ota et al.

(10) Patent No.: US 9,221,636 B2
(45) Date of Patent: Dec. 29, 2015

(54) CONVEYING DEVICE AND IMAGE RECORDING APPARATUS

(71) Applicants: Yasuhira Ota, Yatomi (JP); Masao Mimoto, Nagoya (JP); Iwane Sano, Obu (JP); Keisuke Wakakusa, Nagoya (JP); Jie Xiu, Nagoya (JP); Noriyuki Kawamata, Nagoya (JP); Shingo Ito, Kasugai (JP)

(72) Inventors: Yasuhira Ota, Yatomi (JP); Masao Mimoto, Nagoya (JP); Iwane Sano, Obu (JP); Keisuke Wakakusa, Nagoya (JP); Jie Xiu, Nagoya (JP); Noriyuki Kawamata, Nagoya (JP); Shingo Ito, Kasugai (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/179,755

(22) Filed: Feb. 13, 2014

(65) Prior Publication Data

US 2014/0232054 A1 Aug. 21, 2014

(30) Foreign Application Priority Data

Feb. 18, 2013 (JP) ..... 2013-029341

(51) Int. Cl.

| | |
|---|---|
| ***B65H 7/14*** | (2006.01) |
| ***B65H 5/06*** | (2006.01) |
| ***B65H 5/38*** | (2006.01) |

(52) U.S. Cl.

CPC ..... *B65H 7/14* (2013.01); *B65H 5/062* (2013.01); *B65H 5/38* (2013.01); *B65H 2301/44318* (2013.01); *B65H 2301/531* (2013.01); *B65H 2402/441* (2013.01); *B65H 2402/46* (2013.01); *B65H 2404/6111* (2013.01); *B65H 2553/612* (2013.01); *B65H 2601/26* (2013.01); *B65H 2601/321* (2013.01); *B65H 2801/12* (2013.01)

(58) Field of Classification Search

CPC ..... B65H 5/062; B65H 5/38; B65H 7/02; B65H 7/14; B65H 2402/441; B65H 2402/45; B65H 2601/26; B65H 2601/321; B65H 2301/44318

USPC ..... 271/265.01, 264.04, 262, 258.01, 264, 271/10.03

See application file for complete search history.

(56) References Cited

U.S. PATENT DOCUMENTS 4,925,177 A * 5/1990 Nakamura et al. ..... 271/110
5,365,322 A * 11/1994 Hamada et al. ..... 399/21

(Continued)

FOREIGN PATENT DOCUMENTS

JP 04007245 A * 1/1992
JP H05-278897 10/1993

(Continued)

*Primary Examiner* — Ernesto Suarez
(74) *Attorney, Agent, or Firm* — Frommer Lawrence & Haug LLP

(57) ABSTRACT

A conveying device includes: a conveyor for conveying a sheet; a path defining member having a first conveying surface that guides the sheet; and a sensor device for sensing the sheet. The sensor device includes: a sensor casing provided on the path defining member and including a second conveying surface that guides the sheet and a main wall whose outer surface is exposed from the path defining member and contiguous to the first conveying surface; a movable member including (i) a contact portion projecting to a second-conveying-surface side of the main wall through an opening formed in the main wall and (ii) a sensed portion located in the sensor casing and moved by the sheet conveyed on the second conveying surface while contacting the contact portion; and a signal output device, provided in the sensor casing, for sensing the sensed portion to output a signal related to its position.

14 Claims, 11 Drawing Sheets

(56) References Cited

U.S. PATENT DOCUMENTS

| | | | | |
|---|---|---|---|---|
| 6,364,556 | B1 * | 4/2002 | Barbera et al. | 400/708 |
| 7,435,025 | B2 * | 10/2008 | Tanahashi et al. | 400/625 |
| 7,620,356 | B2 * | 11/2009 | Moteki et al. | 399/329 |
| 8,340,563 | B2 * | 12/2012 | Nakajima et al. | 399/389 |
| 2009/0213391 | A1 * | 8/2009 | Ichikawa | 358/1.1 |

FOREIGN PATENT DOCUMENTS

| | | |
|---|---|---|
| JP | 2009-046294 | 3/2009 |
| JP | 2009/051625 | 3/2009 |

* cited by examiner

10

CONVEYING DEVICE AND IMAGE RECORDING APPARATUS

CROSS REFERENCE TO RELATED APPLICATION

The present application claims priority from Japanese Patent Application No. 2013-029341, which was filed on Feb. 18, 2013, the disclosure of which is herein incorporated by reference in its entirety.

BACKGROUND OF THE INVENTION

1. Field of the Invention

The present invention relates to a conveying device and an image recording apparatus including a sensor for sensing a sheet.

2. Description of the Related Art

There is conventionally known an image recording apparatus configured to record an image on a sheet conveyed by a conveyor roller. The conventional image recording apparatus includes: a conveyor roller pair configured to nip and convey a sheet; and a recording device configured to record an image on the sheet conveyed by the conveyor roller pair, for example.

Some image recording apparatuses having the above-described construction include a sensor disposed on a conveyance path to sense the presence or absence of the sheet in order to control operations for supplying a sheet, and determine whether there is a sheet jam or not. For example, disposed on the sheet conveying path is a sensor including, as a unit, a sensing lever with which a sheet is brought into contact, an optical sensor constituted by a light emitter and a light receiver, and an electric circuit for controlling the optical sensor.

SUMMARY OF THE INVENTION

In the image recording apparatus having such construction, a face of the sensor which faces the sheet conveying path is not covered. Thus, the sheet on the conveyance path may get snagged on the sensor, causing a skew or a jam of a sheet. Since the optical sensor is kept exposed to the conveyance path, dust may land on the optical sensor, or the light receiver may erroneously sense light that differs from one emitted from the light emitter.

This invention has been developed to provide a conveying device configured to reliably sense a sheet on a conveyance path and ensure smooth conveyance of the sheet, and an image recording apparatus including such a conveying device.

The present invention provides a conveying device comprising: a conveyor configured to convey a sheet in a conveying direction; a path defining member comprising a first conveying surface that guides the sheet conveyed by the conveyor; and a sensor device configured to sense the sheet conveyed by the conveyor and comprising: a sensor casing comprising a main wall and provided on the path defining member such that an outer surface of the main wall, which is exposed from the path defining member is contiguous to the first conveying surface, the sensor casing further comprising a second conveying surface which guides the sheet conveyed by the conveyor; a movable member comprising (i) a contact portion projecting to a side of the main wall on which the second conveying surface is located, through a casing opening formed in the main wall and (ii) a sensed portion which is located in the sensor casing and moved from a first position to a second position by movement of the sheet that is conveyed on the second conveying surface while contacting the contact portion; and a signal output device provided in the sensor casing and configured to sense a position of the sensed portion to output a signal related to the position of the sensed portion.

BRIEF DESCRIPTION OF THE RAW NO

The objects, features, advantages, and technical and industrial significance of the present invention will be better understood by reading the following detailed description of the embodiment of the invention, when considered in connection with the accompanying drawings, in which.

Figure 5:
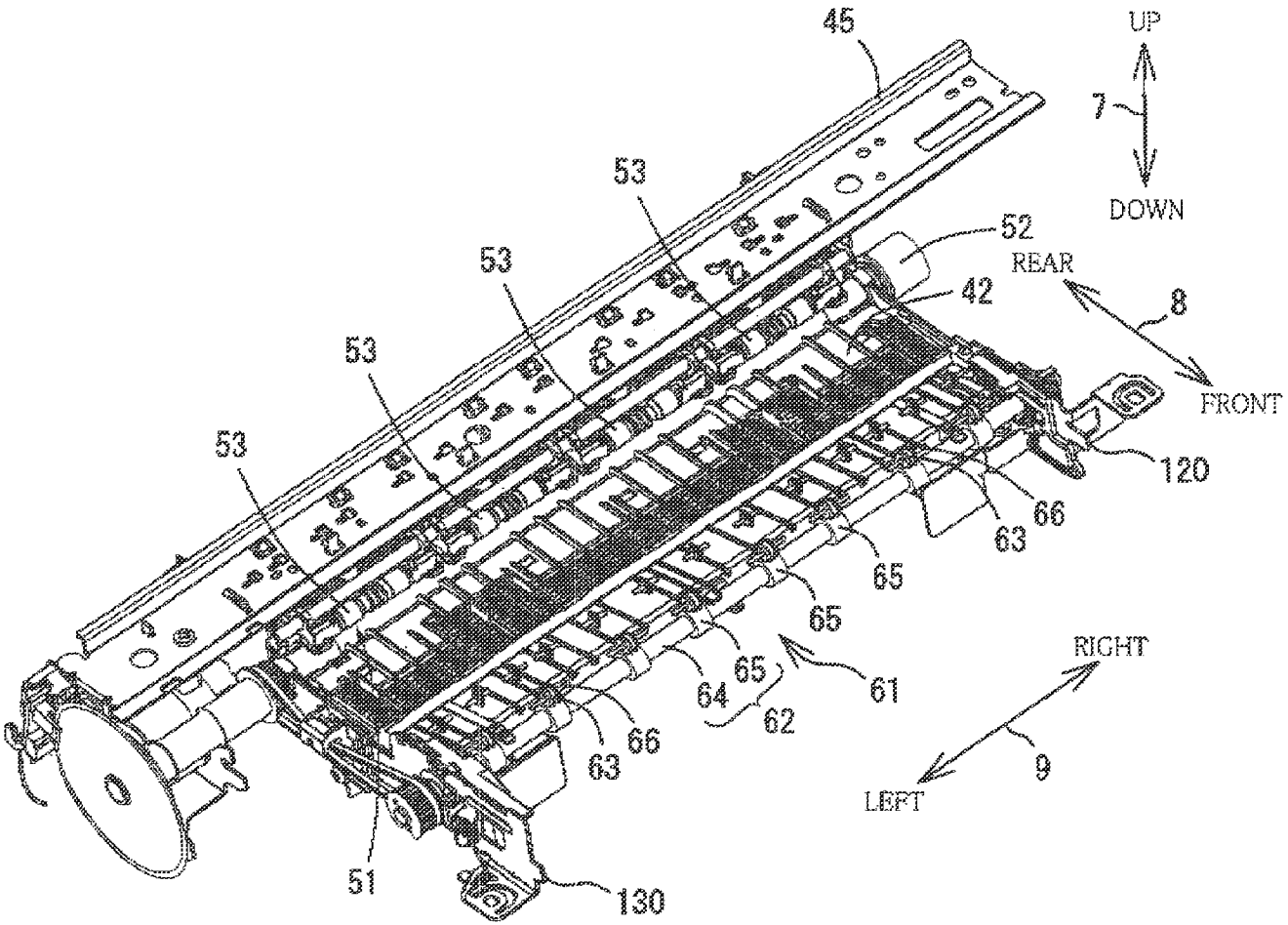
Figure 6:
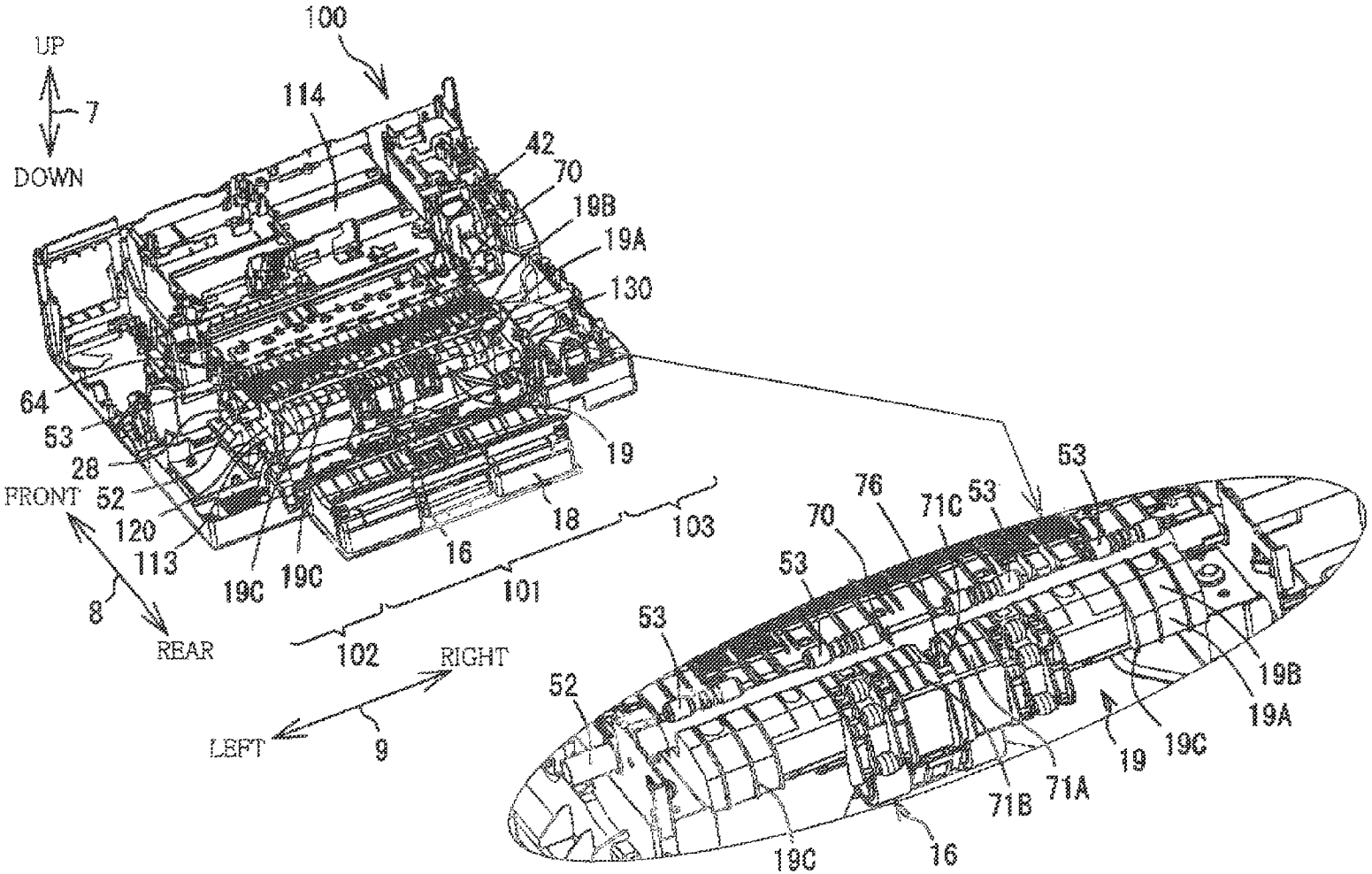
Figure 7:
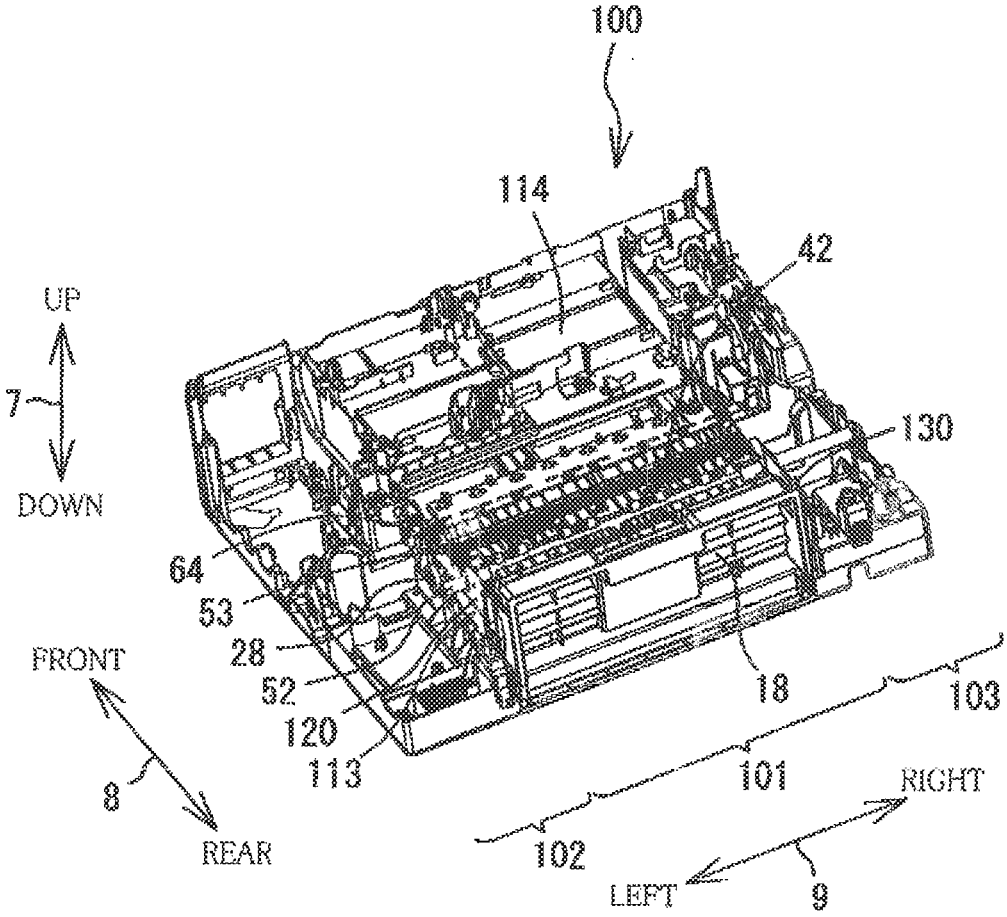
Figure 8:
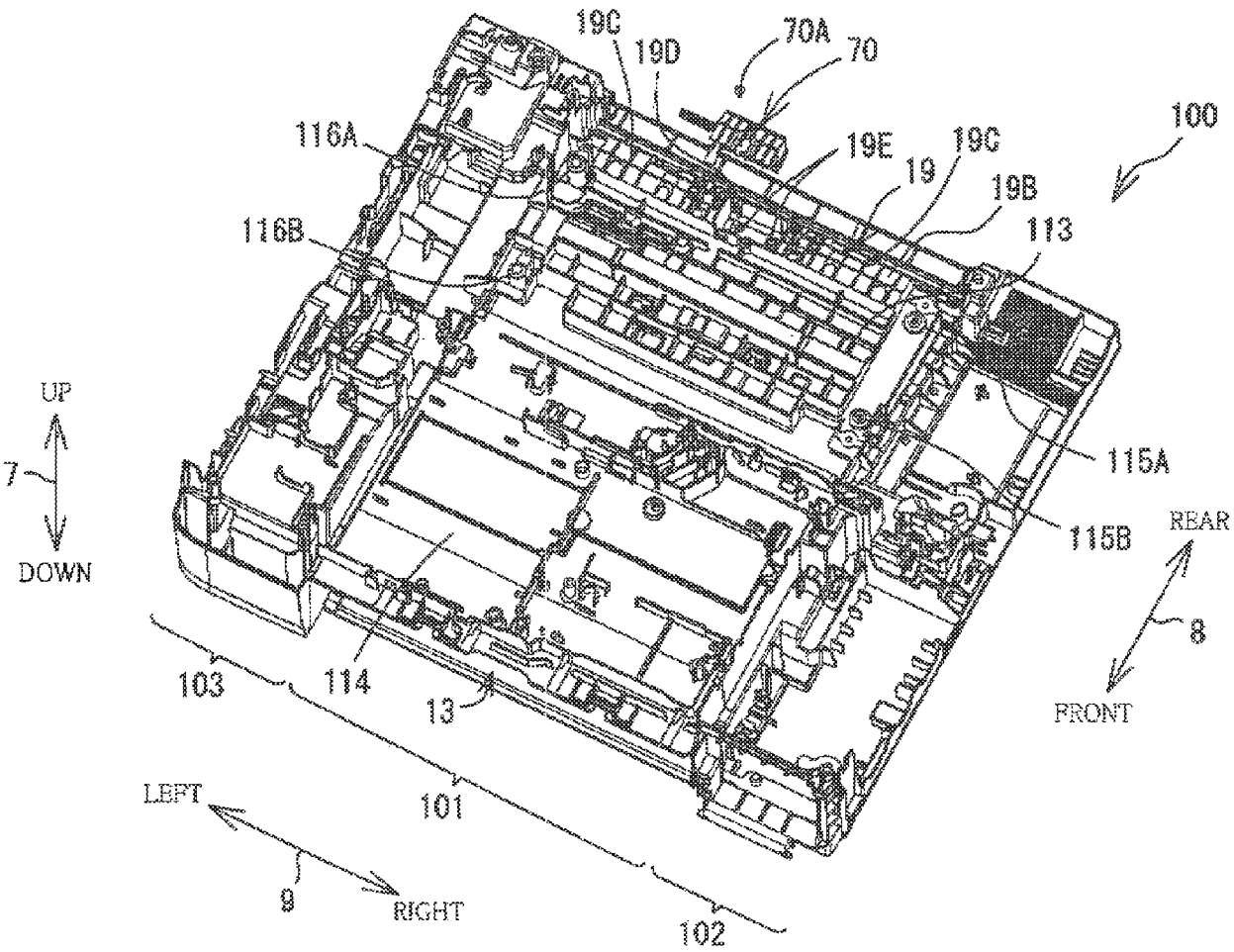
Figure 9B:
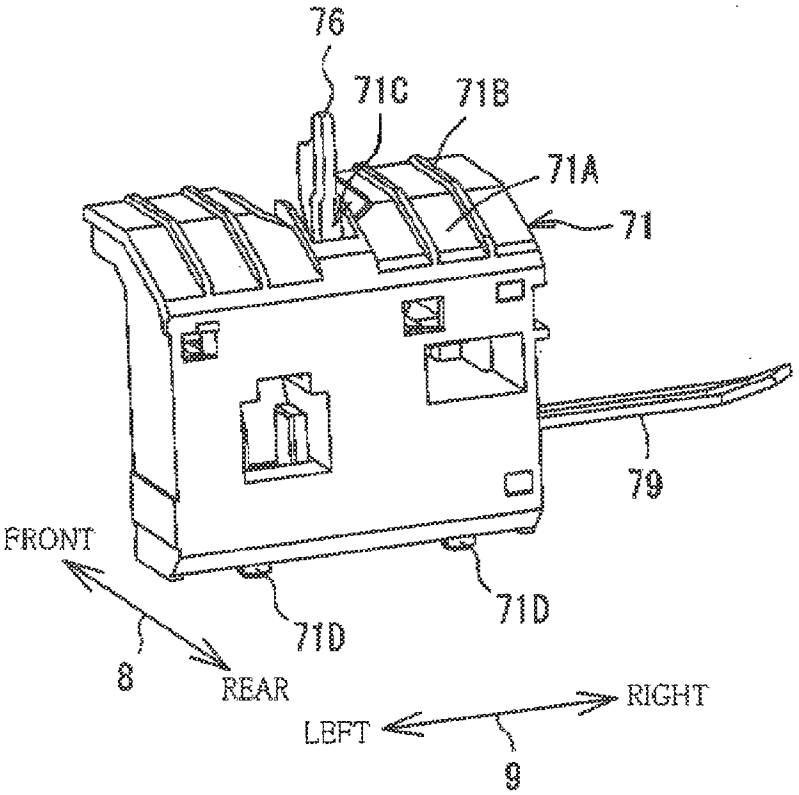
Figure 9A:
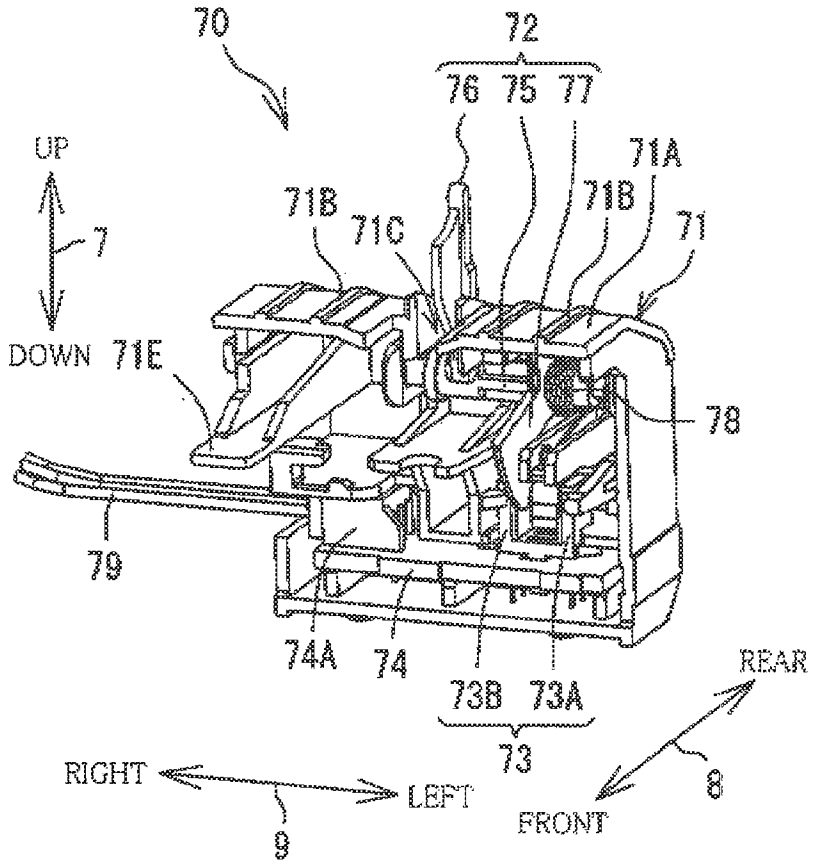
Figure 10:
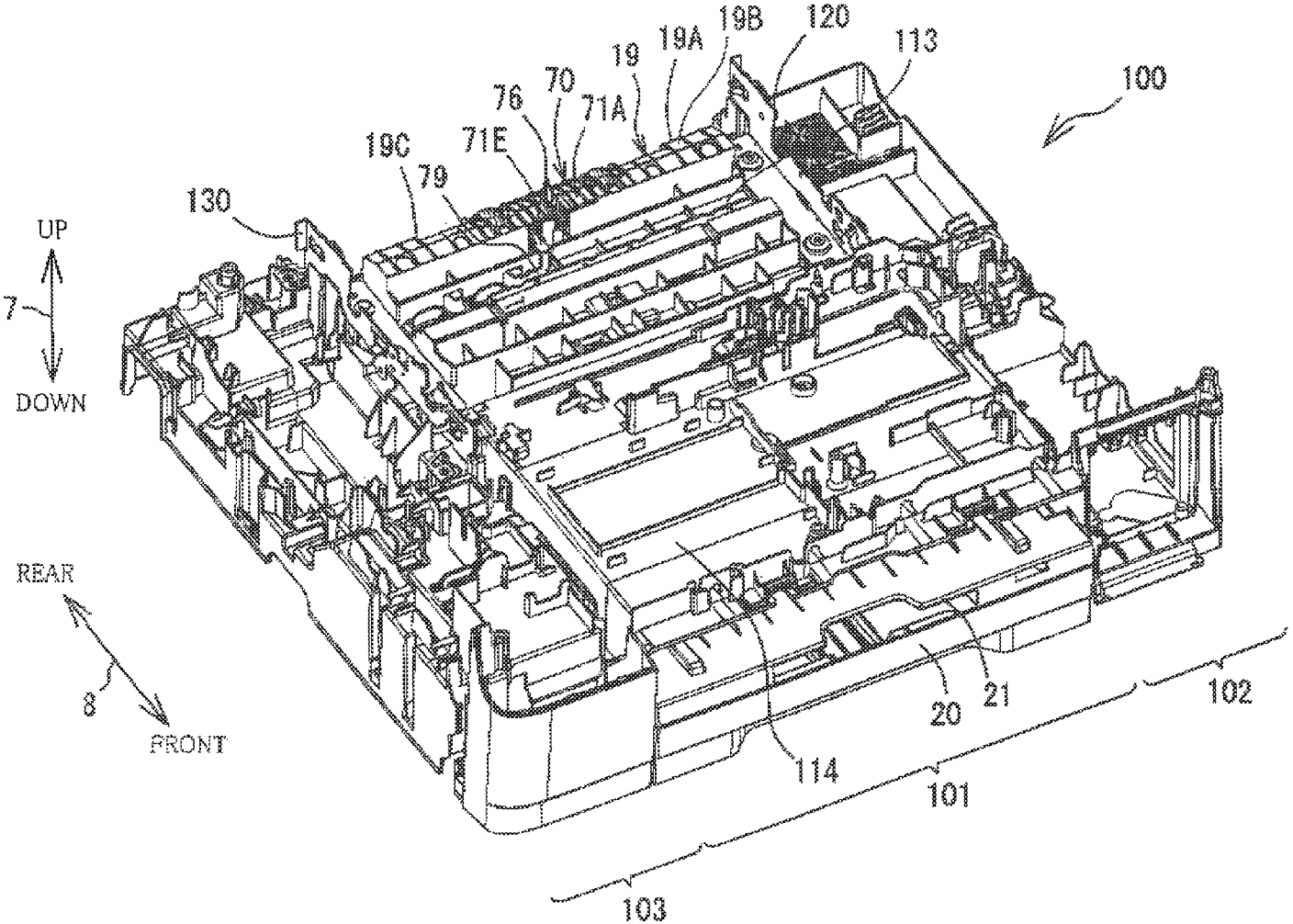
Figure 11B:
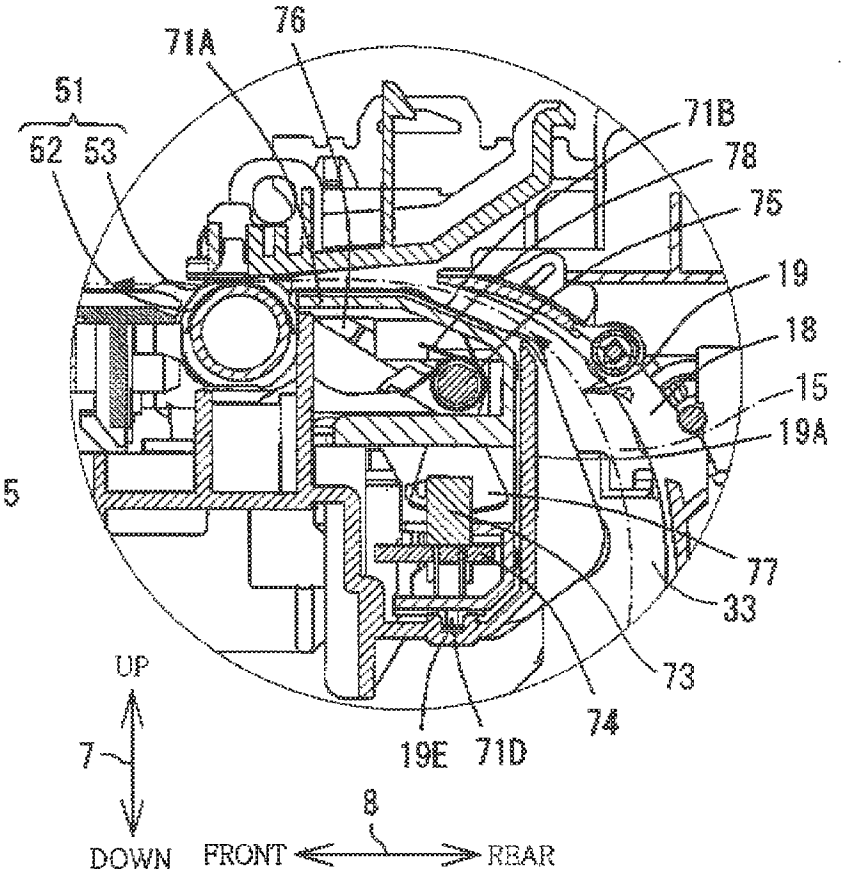
Figure 11A:
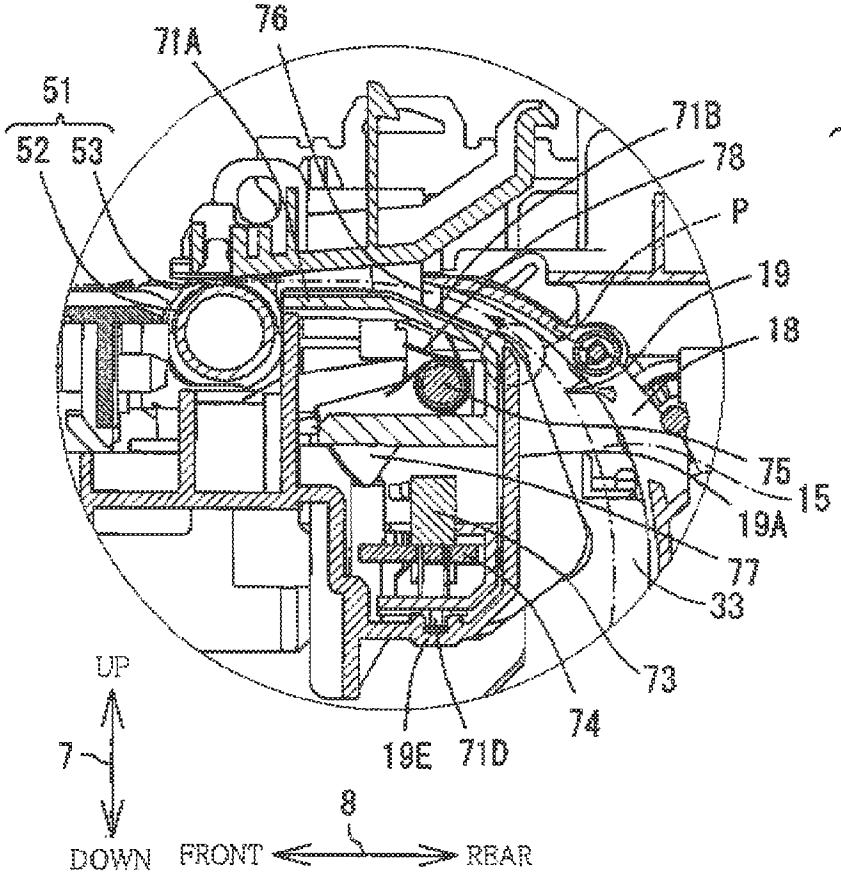

FIG. 5 is a perspective view illustrating a guide rail 45, a conveyor roller pair 51, a platen 42, and an output roller pair 61 supported by the side frames 120, 130;

FIG. 6 is a perspective view illustrating the base member 100 in a state in which an outer guide member 18 is located at an exposing position and an enlarged perspective view illustrating an inner guide member 19;

FIG. 7 is a perspective view illustrating the base member 100 in a state in which the outer guide member 18 is located at a covering position;

FIG. 8 is an exploded perspective view illustrating the base member 100 and a sensor unit 70;

FIGS. 9A and 9B are perspective views illustrating the sensor unit 70, wherein FIG. 9A is a view seen from the front, and FIG. 9B is a view seen from the back;

FIG. 10 is a perspective view illustrating the base member 100 on which the sensor unit 70 is mounted; and FIGS. 11A and 11B are partial cross-sectional views illustrating components near the sensor unit 70, wherein FIG. 11A illustrates a state in which a movable member 72 is in a first orientation, and FIG. 11B illustrates a state in which the movable member 72 is in a second orientation.

DETAILED DESCRIPTION OP THE EMBODIMENT

Hereinafter, there will be described one embodiment of the present invention by reference to the drawings. It is to be understood that the following embodiment is described only by way of example, and the invention may be otherwise embodied with various modifications without departing from the scope and spirit of the invention. A multi-function peripheral (MFP) 10 is used in a state illustrated in FIG. 1. In the present embodiment, three arrows illustrated in FIG. 1 indicate an up and down direction 7, a front and rear direction 8, and a right and left direction 9. In the following explanation, the up and down direction 7 is defined as an up and down direction of the MFP 10 illustrated in FIG. 1, i.e., the MFP 10 being in a normal state. Also, the front and rear direction 8 is defined by regarding a side of the MFP 10 on which an opening 13 is formed as a front side, and the right and left direction 9 is defined in a state in which the MFP 10 is seen from the front side.

<Overall Structure of MFP 10>

Figure 1:
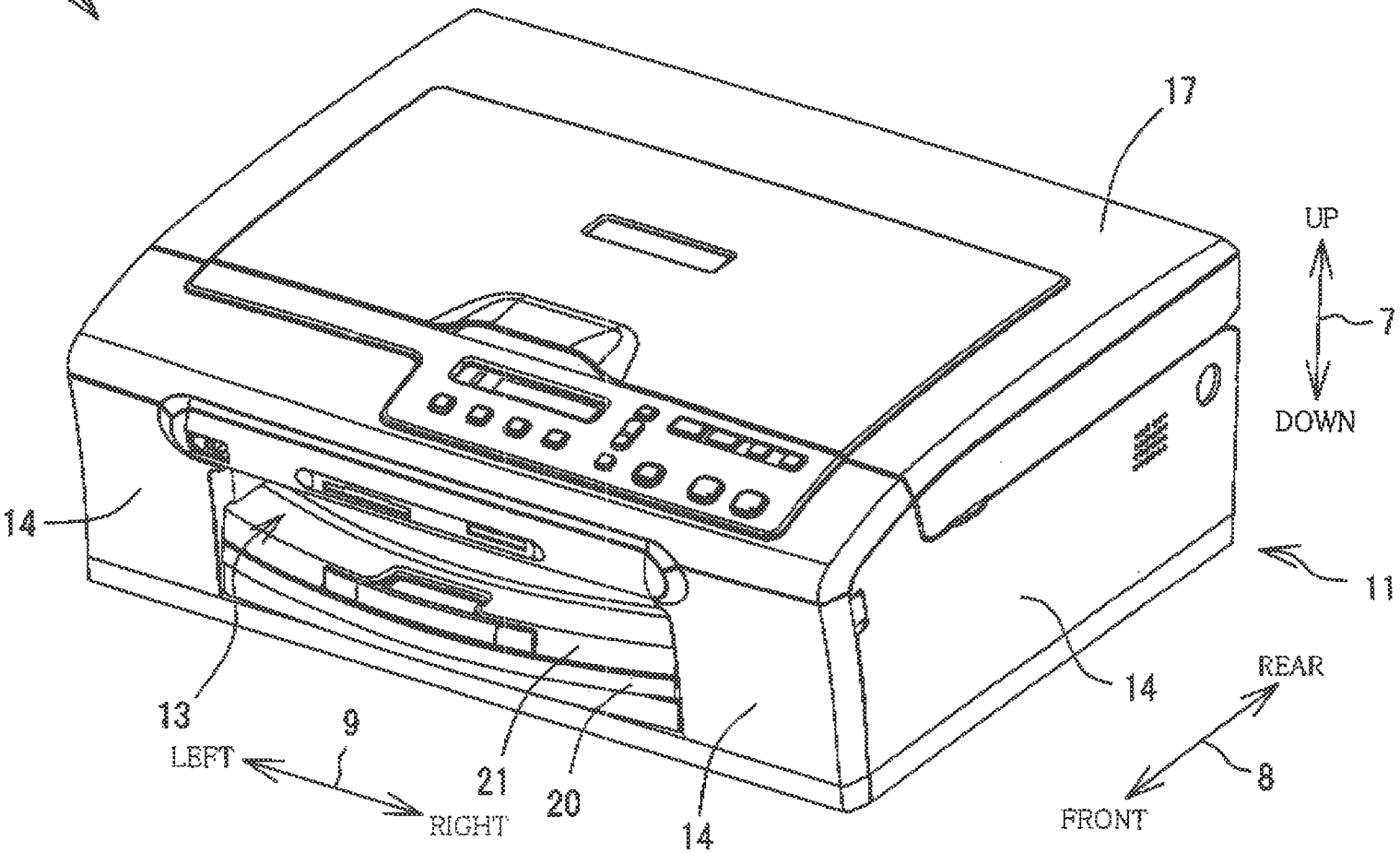
FIG. 1 is a perspective view illustrating a multi-function peripheral (MFP) 10 as one example of an embodiment of the present invention.

As illustrated in FIG. 1, the MFP 10 as one example of an image recording apparatus according to the present invention is of a slim type having a generally rectangular parallelepiped shape. A printing section 11 is provided in a lower portion of the MFP 10. The MFP 10 has various functions such as a facsimile function and a printing function. One example of the printing function of the MFP 10 is a function for ejecting ink to record an image on one side of a recording sheet 12 (see FIG. 2). It is noted that the MFP 10 may be configured to record images on both sides of the recording sheet 12. A conveying device is provided in the MFP 10. The conveying device is configured to convey the recording sheet 12 in the MFP 10 and includes an inner guide member 19, a conveyor unit 80, and a sensor unit 70 which will be described below.

As illustrated in FIG. 1, the opening 13 is formed in a front face of the printing section 11. A supply tray 20 capable of accommodating recording sheets 12 of various sizes can be inserted into and removed from the printing section 11 through the opening 13 in the front and rear direction 8. An output tray 21 is stacked on the supply tray 20. The output tray 21 is moved together with the supply fray 20. The output tray 21 supports a recording sheet 12 recorded by a recording unit 24 which will be described below and discharged by an output roller pair 61 which will be described below. An upper face of the printing section 11 is provided with a cover member 17. The cover member 17 pivots about an axis extending in the right and left direction 9, with its rear end in the front and rear direction 8 as a basal end and its front end as a free end. In this structure, the upper face of the printing section 11 is opened and closed.

<Supply Tray 20>

Figure 3:
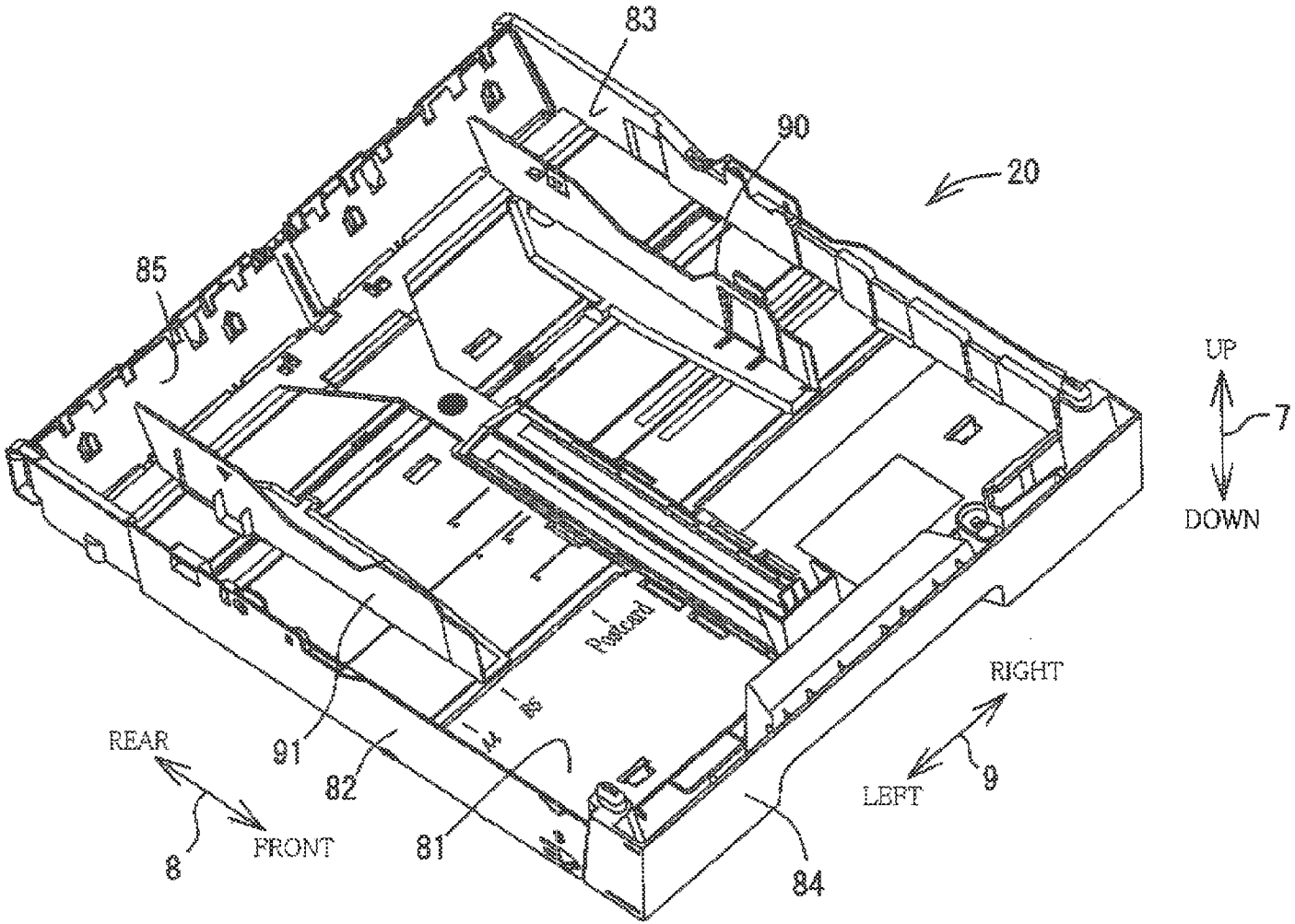
FIG. 3 is a perspective view illustrating a supply tray 20.

As illustrated in FIG. 3, the supply tray 20 has a box shape opening upward and includes a bottom plate 81, a left side plate 82, a right side plate 83, a front plate 84, and an inclined plate 85. The left side plate 82 and the right side plate 83 project upward respectively from opposite edge portions of the bottom plate 81 in the right and left direction 9. The front plate 84 projects upward from a front edge portion of the bottom plate 81 in the front and rear direction 8. The output tray 21 is supported by the left side plate 82, the right side plate 83, and the front plate 84 (see FIG. 1). The inclined plate 85 extends in a rear upward direction from a rear end of the bottom plate 81 in the front and rear direction 8 to guide a recording sheet 12 to a conveyance path 35 after the recording sheet 12 is supplied from a supply unit 16.

The bottom plate 81 can support recording sheets 12 of a plurality of standard sizes such as the A4 size, the B5 size, the legal size, and the postcard size. The bottom plate 81 has marks each indicating a position of one of edge portions (a left; edge portion in the example in FIG. 3) of the recording sheet 12 of a corresponding one of the various standard sizes in the right and left direction 9. FIG. 3 illustrates "A4", "B5", and "Postcard" as examples of the mark, but other marks may be used of course. As illustrated in FIG. 3, provided on the bottom plate 81 are guide members 90, 91 for positioning a recording sheet or sheets 12 placed on the bottom plate 81 by contacting opposite edges of the recording sheet(s) 12 in the right and left direction. The guide members 90, 91 use center alignment to prevent skew of the recording sheet 12 and to position the various standard sizes of the recording sheets 12 placed on the bottom plate 81. The center alignment is an operation for aligning a center of each recording sheet 12 in the right and left direction 9 to a center of the bottom plate 81 in the right and left direction 9.

A user places the recording sheet(s) 12 on the bottom plate 81 such that the center of each recording sheet 12 is aligned to a center line (as one example of a reference position) of the bottom plate 81 in the right and left direction 9. The user then slides the guide member 90 (as one example of a positioning member) in the left direction of the right and left direction 9 to a position indicated by the mark that corresponds to the size of the recording sheet(s) 12, so that the guide member 90 is brought into contact with a right edge of the recording sheet(s) 12. The guide member 91 is slid in the right direction by a pinion gear, not shown, in conjunction with the guide member 90 and brought into contact with a left edge of the recording sheet(s) 12. The recording sheet or sheets 12 of the various standard sizes placed on the bottom plate 81 are thus positioned by the guide members 90, 91 using the center alignment.

Figure 2:
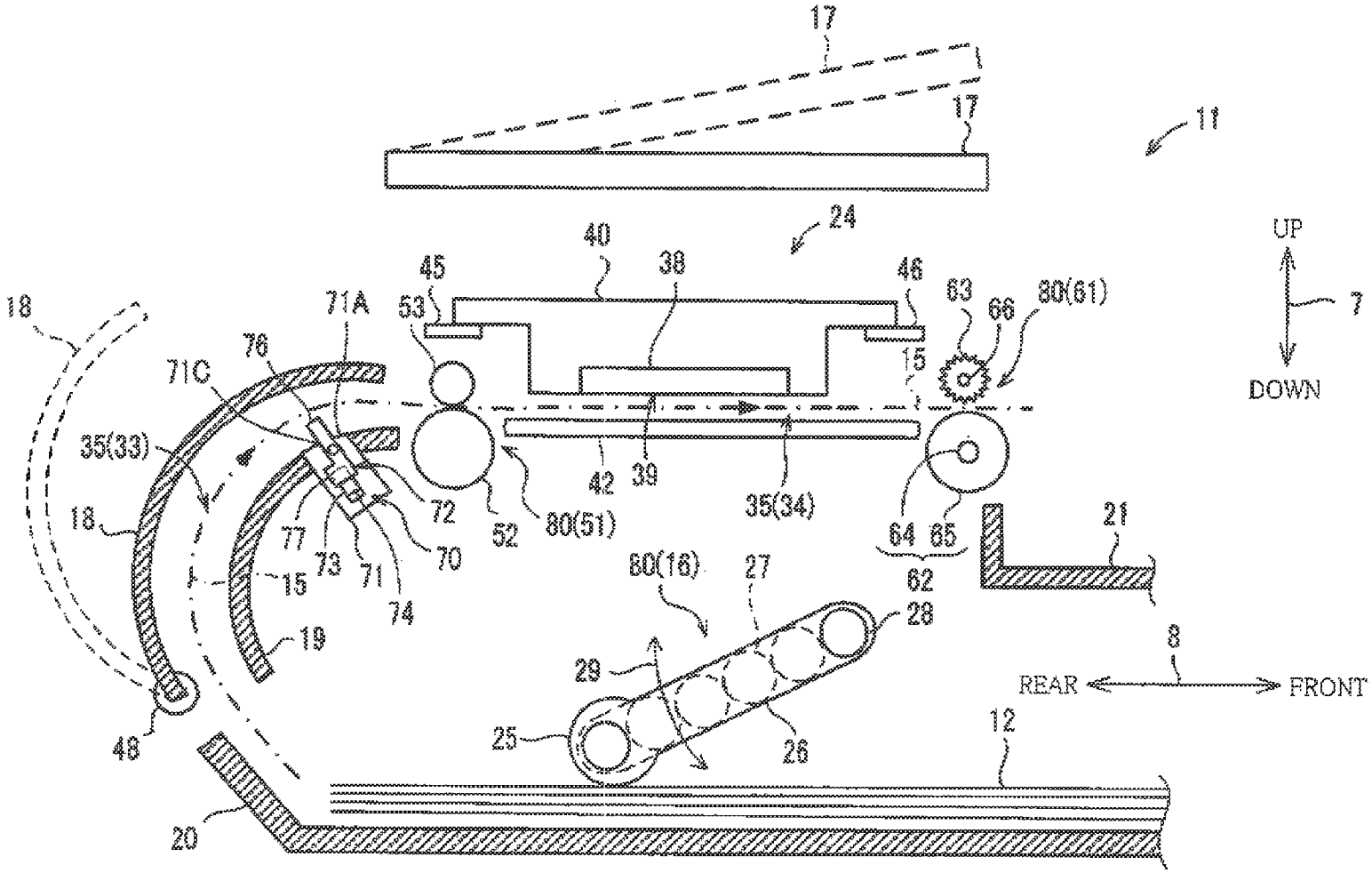
FIG. 2 is an elevational view in vertical cross section schematically illustrating an internal structure of a printing section 11.

The printing section 11 includes a base member 100 (see FIG. 4) and an exterior cover 14 for covering the base member 100 from above. As illustrated in FIG. 2, components provided in the printing section 11 include the supply unit 16, a conveyor roller pair 51, the recording unit 24, the output roller pair 61, and a platen 42. The base member 100 supports the supply unit 16, the conveyor roller pair 51, the recording unit 24, the output roller pair 61, the platen 42, side frames 120, 130, and other components. The base member 100 is covered with the exterior cover 14.

The supply unit 16 picks up one of the recording sheets 12 from the supply tray 20 to supply the recording sheet 12 to the conveyance path 35. The conveyor roller pair 51 conveys the recording sheet 12 supplied by the supply unit 16 into the conveyance path 35, to a downstream side in a conveying direction 15. The recording unit 24 ejects ink droplets onto the recording sheet 12 conveyed by the conveyor roller pair 51, to record an image on the recording sheet 12. The output roller pair 61 discharges onto the output tray 21 the recording sheet 12 recorded by the recording unit 24. The platen 42 supports a lower side of the recording sheet 12 conveyed by the conveyor roller pair 51.

<Conveyance Path 35>

As illustrated in FIG. 2, the conveyance path 35 extends from a rear edge portion of the supply tray 20. The conveyance path 35 includes a curved conveyance path 33 and a straight conveyance path 34. The curved conveyance path 33 curves, with a rear side of the printing section 11 being as an outside of the path 33. The straight conveyance path 34 extends in the front and rear direction 8. The recording sheet 12 supported on the supply tray 20 is conveyed so as to make an upward U-turn through the curved conveyance path 33 from a lower portion thereof and then conveyed frontward in the front and rear direction 8 through the straight conveyance path 34 to the recording unit 24. After the image recording for the recording unit 24, the recording sheet 12 is conveyed frontward in the front and rear direction 8 through the straight conveyance path 34 and discharged onto the output tray 21. That is, the recording sheet 12 is conveyed in the conveying direction 15 indicated by one-dot chain line arrow in FIG. 2.

The curved conveyance path 33 is defined by an outer guide member 18 (as one example of a facing member) and the inner guide member 19 (as one example of a path defining member) which are opposed to each other with a predetermined, distance therebetween. The outer guide member 18 serves as an outer wall of the curved conveyance path 31, and the inner guide member 19 serves as an inner wall of the curved conveyance path 33. The straight conveyance path 34 is defined by the recording unit 24 and the platen 42 which are opposed to each other with a predetermined distance therebetween at a position where the recording unit 24 is disposed. That is, each of the guide members 18, 19 forms at least a portion of the conveyance path 35.

The outer guide member 18 is pivotably supported by the base member 100 which will be described below. Shafts 48 each extending in the right and left direction 9 are formed respectively on opposite ends of a lower end portion of the outer guide member 18 in the right and left direction 9. In the present embodiment, each of the shafts 48 is a projection extending outward from a corresponding one of the opposite ends of the outer guide member 18 in the right and left direction 9. The shafts 48 are fitted in holes, not shown, formed in the base member 100. As a result, the outer guide member 18 is pivotable between a covering position (indicated by solid lines in FIG. 2) where the outer guide member 18 covers the curved conveyance path 33 and an exposing position (indicated by broken lines in FIG. 2) where the outer guide member 18 exposes the curved conveyance path 33.

At the covering position, the outer guide member 18 defines the curved conveyance path 33 of the conveyance path 35 with the inner guide member 19. At the exposing position of the outer guide member 18, on the other hand, an outside face of the inner guide member 19 is exposed to an outside of the printing section 11. That is, the outer guide member 18 at the exposing position exposes the curved conveyance path 33 of the conveyance path 35 to the outside. As a result, the user of the MFP 10 can clear a recording sheet 12 stuck in the curved conveyance path 33, in other words, the user can perform a jam clearing operation.

<Conveyor Unit 80>

The conveyor unit 80 includes: the supply unit 16 disposed upstream of the curved conveyance path 33 in the conveying direction 15; the conveyor roller pair 51 disposed in the straight conveyance path 34 at a position located upstream of the recording unit 24 in the conveying direction 15; and the output roller pair 61 disposed in the straight conveyance path 34 at a position located downstream of the recording unit 24 in the conveying direction 15.

<Supply Unit 16>

As illustrated in FIG. 2, the supply unit 16 is provided above the supply tray 20 and under the recording trait 24 in the printing section 11. The supply unit 16 includes a supply roller 25 (as one example of a first conveyor roller), a supply arm 26, and a drive-power transmitting mechanism 27. The supply roller 25 is supported by a shaft at a distal end portion of the supply arm 26. The supply arm 26 pivots in a direction indicated by arrow 29 about a support shaft 28 provided on a basal end portion of the supply arm 26. As a result, the supply roller 25 can be moved toward and away from the supply tray 20 or the recording sheet 12 supported on the supply tray 20. The supply roller 25 is rotated by a driving force produced by a conveyor motor, not shown, which is transmitted by the drive-power transmitting mechanism 27 constituted by a plurality of gears. It is noted that the supply roller 25 may be rotated by a driving force applied from a motor provided independently of the conveyor motor.

<Conveyor Roller Pair 51>

As illustrated in FIG. 2, the conveyor roller pair 51 is constituted by a conveyor roller 52 (as one example of a second conveyor roller) and pinch rollers 53. In the present embodiment, the conveyor roller 52 is formed by coating an outer circumferential surface of a roller shall with ceramic, for example. Also, a metal cylindrical shaft (e.g., a hollow shaft) is employed as the roller shaft in the present embodiment. However, a concrete structure of the conveyor roller 52 is not limited to this structure. For example, the conveyor roller 52 may be (boned by fitting a roller on the roller shaft, and a solid shaft may be employed as the roller shaft.

In the present embodiment, the conveyor roller 52 is disposed in a lower portion of the straight conveyance path 34 and contacts a lower side of the recording sheet 12 conveyed from the curved conveyance path 33 to the straight conveyance path 34. The conveyor roller 52 is rotated by a driving force applied from a conveyor motor that is capable of rotating forwardly and reversely. On the other hand, the pinch rollers 53 are disposed in an upper portion of the straight conveyance path 34 so as to be opposed to the conveyor roller 52 and contact an upper side of the recording sheet 12. The pinch rollers 53 are rotated by the rotation of the conveyor roller 52. The conveyor roller 52 and the pinch rollers 53 cooperate to nip the recording sheet 12 in the up and down direction 7 to convey the recording sheet 12 in the conveying direction 15.

<Output Roller Pair 61>

As illustrated in FIG. 2, the output roller pair 61 is constituted by an output roller 62 (as one example of a third conveyor roller) and spurs 63. In the present embodiment, the output roller 62 is disposed in a lower portion of the straight conveyance path 34 and contacts the lower side of the recording sheet 12 conveyed through the straight conveyance path 34. The output roller 62 is constituted by a shaft 64 rotated by a driving force applied from the conveyor motor and rollers 65 fitted on the shaft 64 so as to be rotated together with the shaft 64. On the other hand, the spurs 63 are disposed in an upper portion of the straight conveyance path 34 so as to be opposed to the output roller 62 and contact the upper side of the recording sheet 12. The spurs 63 are respectively fitted on shafts 66 and rotated by the rotation of the output roller 62. The output roller 62 and the spurs 63 cooperate to nip the recording sheet 12 in the up and down direction 7 to convey the recording sheet 12 in the conveying direction 15.

<Platen 42>

As illustrated in FIG. 2, the platen 42 is provided in a lower portion of the straight conveyance path 34 and between the conveyor roller pair 51 and the output roller pair 61, that is, the platen 42 is provided downstream of the conveyor roller pair 51 in the conveying direction 15 and upstream of the output roller pair 61 in the conveying direction 15. The platen 42 is disposed so as to be opposed to the recording unit 24 in the up and down direction 7 to support the lower side of the recording sheet 12 conveyed through the straight conveyance path 34.

<Recording Unit 24>

As illustrated in FIG. 2, the recording unit 24 is disposed in an upper portion of the straight conveyance path 34 so as to be opposed to the platen 42 in the up and down direction 7. The recording unit 24 includes a carriage 40 and a recording head 38. The carriage 40 is supported by two guide raids 45, 46. The two guide rails 45, 46 each extending in the right and left direction 9 are arranged so as to be spaced apart from each other in the front and rear direction 8. The carriage 40 is disposed over the two guide rails 45, 46 and reciprocated along the two guide rails 45, 46 in the right and left direction 9 ejects a main scanning direction. The recording head 38 is mounted on the carriage 40. A lower face of the recording head 38 has nozzles 39 through which the recording head 38 ejects ink supplied from an ink cartridge, not shown. That is, during the reciprocation of the carriage 40 in the right and left direction 9, the recording head 38 ejects irk droplets from the nozzles 39 toward the platen 42 to record an image on the recording sheet 12 supported on the platen 42.

<Cover Member 17>

The cover member 17 is movable between a covering position (indicated by solid lines in FIG. 2) and an exposing position (indicated by broken lines in FIG. 2). The covering position is a position where the cover member 17 covers a portion of the straight conveyance path 34 which is located between the conveyor roller pair 51 and the output roller pair 61 (in other words, a portion of the straight conveyance path which is opposed to the recording unit 24), and the exposing position is a position where the portion of the straight conveyance path 34 is exposed by the cover member 17. This structure allows the user of the MFP 10 to clear a recording sheet 12 stuck in the straight conveyance path 34, in other words, the user can perform a jam clearing operation.

<Base Member 100>

Figure 4:
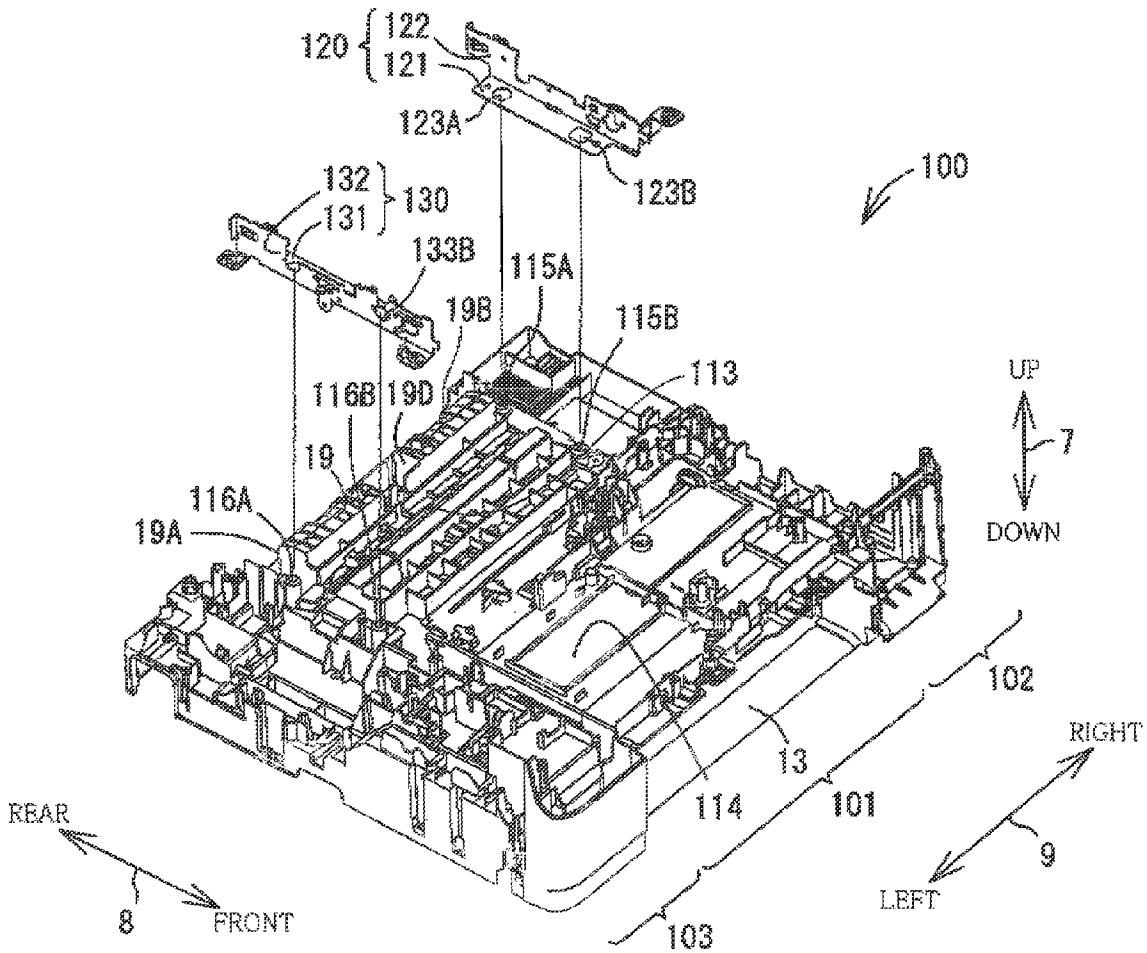
FIG. 4 is an exploded perspective view illustrating a base member 100 and side frames 120, 130.

As illustrated in FIG. 4, the base member 100 is constituted by a center base 101 located at a central portion thereof in the right and left direction 9; and side bases 102, 103 contiguous to the center base 101 in the right and left direction 9. The side base 102 is located on the right side of the center base 101, and the side base 103 on the left side of the center base 101. That is, the side bases 102, 103 are spaced apart from each other in the right and left direction 9. Also, the center base 101 is located between the side bases 102, 103 in the right and left direction 9. In the present embodiment, the base member 100 is formed of resin as one member.

The center base 101 includes: a main board or wall 113 located at its rear portion in the front and rear direction 8; and a main hoard or wall 114 located at its front portion in the front and rear direction 8. The main boards 113, 114 extend between the side bases 102, 103 in the front and rear direction and the right and left direction 9. The main boards 113, 114 are spaced apart from each other in the front and rear direction 8. The main board 113 supports components such as the supply unit 16, the recording unit 24, the conveyor roller pair 51, the output roller pair 61, and the platen 42. The main hoard 114 supports components such as a control board, not shown, for controlling operations of the MIT 10.

As illustrated in FIG. 4, projections 115A, 115B, 116A, 116B are provided on opposite edge portions of the upper surface of the main hoard 113 in the right and left direction 9. The projections 115A, 115B are provided on a right edge portion of the upper surface of the main board 113 so as to be spaced apart from each other in the front and rear direction 8. The projections 116A, 116B are provided on a left edge portion of the upper surface of the main board 113 so as to be spaced apart from each other in the front and rear direction 8. Also, a generally central portion of each of the projections 115A, 115B, 116A, 116B has a threaded hole with which a screw as one example of a fastener is to be engaged.

As illustrated in FIG. 4, the pair of side frames 120, 130 are mounted on the upper surface of the main hoard 113 at positions spaced apart from each other in the right and left direction 9*e*. Each of the side frames 120, 130 is formed by a sheet metal processing. The side frame 120 is constituted by a base portion 121 and a support wall 122 each shaped like a plate, such that the side frame 120 has a generally L-shape in cross section in a widthwise direction thereof. The side frame 130 is constituted by a base portion 131 and a support wall 132 each shaped like a plate, such that the side frame 130 has a generally L-shape in cross section in a widthwise direction thereof.

The base portion 121 is mounted on the upper surface of the main board 113, with its longitudinal direction coinciding with the front and rear direction 8. The base portion 121 has through holes 123A, 123B which are spaced apart from each other in the front and rear direction 8. The projections 115A, 115B of the main board 113 are respectively inserted into the through holes 123A, 123B of the base portion 121, and screws are engaged in the respective projections 115A 115B, whereby the side frame 120 is secured to the main board 113. The support wall 122 stands on one of opposite edge portions of the base portion 121 in its widthwise direction. That is, the support wall 122 in the state in which the side frame 120 is mounted on the main board 113 extends upward and in the front and rear direction 8. The side frame 130 has a construction similar to that of the side frame 120. That is, the base portion 131 has through holes 133A, 133B.

As illustrated in FIG. 5, the guide rails 45, 46, the supply unit 16, the conveyor roller pair 51, and the output roller pair 61 are supported by the side frames 120, 130. The carriage 40 (in other words, the recording unit 24) is supported by the side frames 120, 130 via the guide rails 45, 46. That is, the guide rails 45, 46, the supply unit 16, the conveyor roller pair 51, the recording unit 24, and the output roller pair 61 are supported by the main board 113 of the base member 100.

The inner guide member 19 is provided at a rear end portion of the main board 113 in the front and rear direction 8 (Len, an upstream end portion of the main board 113 in the conveying direction 15). Also, the inner guide member 19 is disposed downstream of the supply unit 16 in the conveying direction 15 and upstream of the conveyor roller 52 in the conveying direction 15. The curved conveyance path 33 curves along a rear end portion of the main board 113 the inner guide member 19) from a side of the main beard 113 nearer to its lower surface to a side of the main board 113 nearer to its upper surface. The straight conveyance path 34 is provided so as to extend linearly in the front and rear direction 8 in a horizontal plane expanding along the upper surface of the main hoard 113 and a lower surface of the main board 114.

As illustrated in FIG. 6, the inner guide member 19 is constituted by: a first wall portion 191 extending generally in the up and down direction 7 and the right and left direction 9; and a second wall portion 19B contiguous to an upper edge of the first wall portion 19A and extending generally in the front and rear direction 8 and the right and left direction 9. That is, the first wall portion 19A and the second wall portion 19B extend in directions intersecting each other. A plurality of ribs 19C are arranged in the right and left direction 9 on surfaces of the first wall portion 19A and the second wall portion 19B, and each of the ribs 19C extends in the conveying direction 15. More specifically, each rib 19C extends generally in the up and down direction 7 on the first wall portion 19A and extends generally in the front and rear direction 8 on the second wall portion 19B. Accordingly, in the present embodiment, a first conveying surface defining the curved conveyance path 33 is an imaginary surface expanding so as to include distal edges of the respectively ribs 19C. In a construction having no ribs, on the other hand, the first conveying surface is constituted by the surfaces of the first wall portion 19A and the second wall portion 19B.

As illustrated in FIGS. 4 and 8, the second wall portion 19B of the inner guide member 19 has an opening 19D at its central portion in the right and left direction 9 (as one example of a widthwise direction). This opening 19D exposes an inner space of the inner guide member 19 which is defined by the first wall portion 19A and the second wall portion 19B. As illustrated in FIG. 6, this inner space accommodates the sensor unit 70. Wall faces defining the inner space include a back or bottom wall face that faces the opening 19D in the up and down direction 7 and that has engaging recessed portions 19E.

The outer guide member 18 pivots between an exposing position illustrated in FIG. 6 and a covering position illustrated in FIG. 7 about an axis extending in the right and left direction 9, with lower and upper ends of the outer guide member 18 being as a pivotal basal end and a free end, respectively. At the exposing position as illustrated in FIG. 6, the outer guide member 18 exposes the inner guide member 19 and the sensor unit 70. At the covering position, on the other hand, as illustrated in FIG. 7, the outer guide member 18 covers the inner guide member 19 and the sensor unit 70 in a state in which a space (i.e., the curved conveyance path 33) is defined between the outer guide member 18 and the inner guide member 19.

<Sensor Unit 70>

As illustrated in FIGS. 9A and 9B, the sensor unit 70 is constituted by a sensor casing or housing 71, a movable member 72, an optical sensor 73 (as one example of a sensor), a sensor circuit board 74, and an urging member 78. As illustrated in FIG. 10, the sensor unit 70 is accommodated in the inner space of the inner guide member 19 and fastened to the inner guide member 19 by a screw 70A (as one example of a fastener) illustrated in FIG. 8. The sensor unit 70 senses whether the recording sheet 12 is present or absent at a position of the sensor unit 70 and sends the control board a signal relating to a result of the sensing.

As illustrated in FIGS. 9A and 9B, the sensor casing 71 has a generally rectangular parallelepiped shape opening in its generally entire hack face and contains the movable member 72, the optical sensor 73, the sensor circuit board 74, and the urging member 78. As illustrated in FIG. 10, in a state in which the sensor unit 70 is mounted on the inner guide member 19, an outer surface of an upper wall 71A (as one example of a main wall) of the sensor casing 71 is exposed without being closed by the inner guide member 19, and the outer surface closes the opening 19D of the inner guide member 19. More specifically, the outer surface of the upper wall 71A of the sensor casing 71 generally flushes with an outer surface of the second wall portion 19B of the inner guide member 19.

Provided on the outer surface of the upper wall 71A axe a plurality of ribs 71B arranged in the right and left direction 9, and each of the ribs 71B extends in the conveying direction 15 (i.e., generally in the front and rear direction 8). Accordingly, as illustrated in the partially enlarged view in FIG. 6, an imaginary surface expanding so as to include distal edges of the ribs 71B provided on the upper wall 71A which are exposed from the inner guide member 19 is a second conveying surface that is contiguous to the first conveying surface of the inner guide member 19 and guides the recording sheet 12 conveyed by the conveyor unit 80. It is noted that in a construction not having the ribs 71B on the upper wall 71A, the second conveying surface is constituted by the outer surface of the upper wall 71A. That is, the curved conveyance path 33 is defined by (i) the first conveying surface provided on the first wall portion 19A and the second all portion 19B of the inner guide member 19 and (ii) the second conveying surface provided on the outer surface of the upper wall 71A of the sensor casing 71.

A central portion of the upper well 71A in the right and left direction 9 has a cutout 71C (as one example of a casing opining) elongated in the front and rear direction 8. A lower face of the sensor casing 71 is provided with engaged protruding portions 71D that are to be inserted in the respective engaging recessed portions 19E of the inner guide member 19. The sensor casing 71 also has a partition portion 71E that is provided below the outer surface of the upper well 71A so as to project rearward (i.e., in a downstream direction in the conveying direction 15 in a state in which the sensor unit 70 is mounted). As illustrated in area P enclosed by a broken-line circle in FIG. 11A, an upstream corner portion oldie upper wall 71A in the conveying direction 15 is covered with a distal edge portion of the first wall portion 19A. Also, in the state in which the sensor casing 71 is mounted on the inner guide member 19, a front edge of the upper wall 71A in the front and rear direction 8 is located at as rear of the conveyor roller pair 51. That is, a downstream edge portion of the upper wall 71A in the conveying direction 15 is located upstream of the conveyor roller pair 51 in the conveying direction 15.

The movable member 72 is constituted by a pivot shaft 75, a contact portion 76, and a sensed portion 77. An orientation of the movable member 72 can be switched between a first orientation illustrated in FIG. 11A and a second orientation illustrated in FIG. 11B. More specifically, when a leading edge of the recording sheet 12 (i.e., a downstream edge portion thereof in the conveying direction 15) is brought into contact with the contact portion 76, the orientation of the movable member 72 is switched from the first orientation to the second orientation. On the other hand, when the trailing edge of the recording sheet 12 (i.e., an upstream edge portion thereof in the conveying direction 15) has passed through the contact portion 76, the orientation of the movable member 72 is switched from the second orientation to the first orientation, it is noted that, when the orientation of the movable member 72 is switched from the first orientation to the second orientation as described above, the sensed portion 77 is moved from a first position to a second position, and when the orientation of the movable member 72 is switched from the second orientation to the first orientation, the sensed portion 77 is moved from the second position to the first position.

The pivot shaft 75 extends in the right and left direction 9 in the sensor casing 71 and is pivotably supported by the sensor casing 71. The contact portion 76 extends outwardly from an outer circumferential surface of the pivot shaft 75, specifically, the contact portion 76 projects from a central portion of the outer circumferential surface in an axial direction of the pivot shaft 75. The sensed portion 77 also extends outwardly from the outer circumferential surface of the pivot shaft 75, specifically, the sensed portion 77 projects from one of opposite end portions (in the present embodiment, a left end portion) of the our circumferential surface in the axial direction of the pivot shaft 75. That is, the contact portion 76 and the sensed portion 77 project from the pivot shaft 75 at different positions in the axial direction of the pivot shaft 75. In other words, the sensed portion 77 is located on a portion of the pivot shaft 75 which is different in its axial direction from the position at which the cutout 71C is formed.

Also, the contact portion 76 projects through the cutout 71C from the outer surface of the pivot shaft 75 to a side of the upper waft 71A nearer to its outer surface (i.e., the second conveying surface). More specifically, in the state in FIG. 9A, the contact portion 76 projects upward through the cutout 71C from the outer surface of the pivot shaft 75 to a side of the upper wall 71A nearer to its outer surface. The sensed portion 77 projects from the outer surface of the pivot shaft 75 in a direction that differs from a direction directed toward the cutout 71C. More specifically, in the state in FIG. 9A, the sensed portion 77 projects downward from the outer surface of the pivot shaft 75, on a side of the sensor casing 71 nearer to its rear face. That is, the contact portion 76 and the sensed portion 77 respectively project in directions that differ from each other in a circumferential direction of the pivot shaft 75.

The optical sensor 73 is electrically connected to the sensor circuit hoard 74 and is supported by the sensor circuit board 74 at a position corresponding to the sensed portion 77 in the up and down direction 7. The optical sensor 73 is constituted by a light emitter 73A and a light receiver 73B which are opposed to each other in the right and left direction 9. The light emitter 73A emits light to the light receiver 73B. The light receiver 73B is disposed in a path of the light emitted from the light emitter 73A to receive the light.

The sensor circuit board 74 is provided in the sensor casing 71 on an opposite side of the pivot shaft 75 from the cutout 71C. That is the sensor circuit board 74 is disposed spaced apart from the upper wall 71A and so on by a creepage distance in order to prevent static electricity from transferring from a user's hand to the sensor circuit board 74. The sensor circuit board 74 is an elongated plate member whose length in the right and left direction 9 is longer than that in the front and rear direction 8. The sensor circuit board 74 supports the optical sensor 73 on one of opposite end portions of an upper face of the sensor circuit board 74 in its longitudinal direction (in the present embodiment, a left end portion) and supports a connector 74A on the other of the opposite end portions (in the present embodiment, a right end portion). To the connector 74A is connected one end of a cable 79 for electrically connecting between the sensor circuit board 74 and the control board.

Depending upon whether light has been received by the light receiver 73B of the optical sensor 73 or not, the sensor circuit board 74 outputs a signal to the control board through the cable 79 connected to the connector 74A. More specifically, when light is received by the light receiver 73B, the sensor circuit board 74 outputs a first signal to the control board. When no light is received by the light receiver 73B, on the other band, the sensor circuit board 74 outputs a second signal that differs from the first signal to the control board. It is noted that the optical sensor 73 and the sensor circuit board 74 are one example of a signal output device.

As illustrated in FIG. 10, the cable 79 extends to an outside of the inner guide member 19 from a space that is formed in a lower portion of the partition portion 71E at a position between the inner guide member 19 and the sensor casing 71. The cable 79 extends to the control board supported on the upper surface of the main board 114, while passing through the ribs provided on the upper surface of the main board 113. It is noted that FIGS. 6 and 10 indicate that the partition portion 71E is located below the conveyor roller 52 in the up and down direction 7. That is, the partition portion 71E is located between the conveyor roller 52 and the cable 79 in the up and down direction 7.

As illustrated in FIGS. 9A and 11A, the movable member 72 is urged by the urging member 7 so as to establish the first orientation in which the sensed portion 77 is located at the first position. As a result, in the state in which the sensed portion 77 is located at the first position, the contact portion 76 of the movable member 72 projects from the second conveying surface, so that the contact portion 76 on contact the leading edge of the recording sheet 12 conveyed by the supply unit 16 through the curved conveyance path 33. At the first position, the sensed portion 77 is not located in the path of the light emitted from the light emitter 73A. That is when the sensed portion 77 is located at the first position, the light receiver 73B receives the light emitted by the light emitter 73A. As a result, the sensor circuit board 74 outputs the first signal to the control board through the cable 79 connected, to the connector 74A.

The recording sheet 12 conveyed by the supply unit 16 through the curved conveyance path 33 is brought into contact with the contact portion 76 to pivot the movable member 72 against an urging force of the urging member 78 such that the movable member 72 takes the second orientation in which the sensed portion 77 is located at the second position as illustrated in FIG. 11B. That is, when the sensor unit 70 is seen in the direction as illustrated in FIG. 11B, the pivot shaft 75 pivots in a counterclockwise direction. Also, the distal end of the contact portion 76 is moved by the recording sheet 12 toward a downstream side in the conveying direction 15. Also, the sensed portion 77 is moved in a direction toward the first wall portion 19A and away from the cutout 71C.

As a result, as illustrated in FIG. 11B, the contact portion 76 is located below the second conveying surface, so that the recording sheet 12 can pass through the curved conveyance path 33. Since the sensed portion 77 is located in the light path between the light emitter 73A and the light receiver 73B, the light receiver 73B does not receive the light emitted from the light emitter 73A. As a result, the sensor circuit board 74 outputs the second signal to the control board through the cable 79 connected to the connector 74A.

When the trailing edge of the recording sheet 12 has conveyed through a position just above the cutout 71C (in other words, a position just above the contact portion 76), the sensed portion 77 returns to the first position illustrated in FIG. 11A by the urging force of the urging member 78. As a result, the sensor circuit board 74 outputs the first signal to the control board through the cable 79 connected to the connector 74A. That is, the sensor circuit hoard 74 outputs a signal related to the position of the sensed portion 77.

<Effects of the Present Embodiment>

In the present embodiment, the inside of the sensor unit 70 mounted on the inner guide member 19 is covered with the upper wall 71A. Also, the optical sensor 73 and the sensor circuit board 74 are disposed at positions far from the cutout 71C in the sensor casing 71. Also, the cutout 71C and the optical sensor 73 are disposed at different positions from each, other in the axial direction of the pivot shaft 75. These structures can prevent a malfunction or damage to the optical sensor 73 and the sensor circuit board 74 due to ingress of dust, outside light, static electricity, and so on into the inside of the sensor casing 71.

In the present embodiment, the sensor unit 70 is exposed to an outside of the MFP 10 by moving the cover member 17 or the outer guide member 18 to the exposing position. Thus, the sensor unit 70 is disposed upstream of the conveyor roller 52 in the conveying direction 15, that is, the sensor unit 70 is disposed on an opposite side of the conveyor roller 52 from the cover member 17, resulting in reduction in effects of the dust, the outside light, the static electricity, and so on entering from the outside of the MFP 10. Likewise, covering the sensor unit 70 with the first wall portion 19A can reduce the effects of the dust, the outside light, the static electricity, and so on entering from the outside of the MFP 10. That is, it is possible to reduce effects of the static electricity and so on which are caused in a case where the jam clearing operation is performed in the state in which the cover member 17 or the outer guide member 18 is located at the exposing position.

In the present embodiment, when moving from the first position to the second position, the sensed portion 77 pivots in the direction toward the first wall portion 19A in the inner guide member 19. Thus, the sensed portion 77 is provided in advance to project, at its first position, from the pivot shaft 75 in a direction away from the first wall portion 19A, whereby the sensor unit 70 can be disposed near the first wall portion 19A without extending the length of the second wall portion 19B in the conveying direction 15, resulting in reduction in size of the MFP 10 in the conveying direction 15. Also, when moving from the first position to the second position, the sensed portion 77 is pivoted in a direction away from the cutout 71C, whereby the optical sensor 73 can be made farther from the cutout 71C.

In the present embodiment, the outer surface of the upper wall 71A constitutes the second conveying surface defining the curved conveyance path 33. Also, the outer surface of the upper wall 71A is provided with the ribs 71B extending in the conveying direction 15. The upstream corner portion of the upper wall 71A in the conveying direction 15 is covered with the distal edge portion of the first wall portion 19A. As a result, the recording sheet 12 can be conveyed smoothly.

In the present embodiment, the partition portion 71E is provided between the conveyor roller 52 and the cable 79, preventing the cable 79 from floating to the position of the conveyance path 35 and from inhibiting the conveyance of the recording sheet 12. Also, the partition portion 71E can prevent the dust, the outside light, the static electricity, and so on from entering into the sensor casing 71 through the space for drawing the cable 79.

In the present embodiment, when the sensor unit 70 is inserted into the inner space of the inner guide member 19 through the opening 19D, the engaged protruding portions 71D are respectively inserted into the engaging recessed portions 19E. This structure can simply and reliably position the sensor unit 70 with respect to the inner guide member 19. As a result, the first conveying surface and the second conveying surface can be reliably made contiguous to each other by a simple mounting operation, whereby the recording sheet 12 can be conveyed smoothly.

It is noted that the structure for positioning the sensor unit 70 with respect to the inner guide member 19 in the front and rear direction 8 and the right and left direction 9 is not limited to the combination of the engaging recessed portions 19E and the engaged protruding portions 71D. For example, this MFP 10 may be configured such that engaging protruding portions are provided on the back wall face of the inner guide member 19, and engaged recessed portions are provided on a face that faces the back wall face of the sensor casing 71. That is, the MFP 10 only needs to be configured such that protruding portions are provided on one of the sensor unit 70 and the inner guide member 19, and recessed portions for receiving the respective protruding portions are provided on the other of the sensor unit 70 and the inner guide member 19.

In the present embodiment, what is called a center registration is employed. In this type of registration, a change of position due to skew is the least at a center of the recording sheet 12 in the widthwise direction. Thus, the contact portion 76 is disposed at the center of the conveying surface in the widthwise direction (i.e., the right and left direction 9), making it possible to accurately obtain the position of the recording sheet 12 using the sensor unit 70. This accurate obtainment leads to image recording with high accuracy.

While the MFP 10 including the inkjet printing section 11 is explained as one example of the conveying device in the above-described embodiment, the present invention is not limited to this MFP 10. For example, the present invention is applicable to a laser printer and a feeder mounted on an image reading apparatus to feed a document.

What is claimed is:

1. A conveying device comprising:

a conveyor configured to convey a sheet in a conveying direction;

a path defining member comprising a first conveying surface that guides the sheet conveyed by the conveyor;

a sensor device configured to sense the sheet conveyed by the conveyor and comprising:

a sensor casing comprising a main wall and provided on the path defining member such that a guide portion, including a second conveying surface, provided on an outer surface of the main wall which is exposed from the path defining member is contiguous to the first conveying surface, the guide portion being configured to guide the sheet conveyed by the conveyor;

a movable member comprising (i) a contact portion projecting to a side of the main wall on which the guide portion is located, through a casing opening formed in the main wall and (ii) a sensed portion which is located in the sensor casing and moved from a first position to a second position by movement of the sheet that is conveyed on the guide portion while contacting the contact portion; and a signal output device provided in the sensor casing and configured to sense a position of the sensed portion to output a signal related to the position of the sensed portion;

a control board configured to control the conveyor; and a cable configured to connect the control board and the signal output device to each other, wherein the cable is located at a downstream end portion of the second conveying surface in the conveying direction and at a back of the second conveying surface in a direction intersecting the conveying direction, and the cable extends from a clearance between the path defining member and the sensor casing to a space located on an opposite side of the path defining member from the inner space thereof, and wherein the sensor casing comprises a partition located between the second conveying surface and the clearance and extending in a direction in which the cable extends.

2. The conveying device according to claim 1, wherein the path defining member comprises: a first wall portion; and a second wall portion contiguous to the first wall portion and located downstream of the first wall portion in the conveying direction, the second wall portion extending in a direction intersecting the first wall portion, wherein the first conveying surface extends on the first wall portion and the second wall portion, wherein the sensor device is accommodated in an inner space of the path defining member which is a space defined by the first wall portion and the second wall portion, wherein the second wall portion has an opening that exposes the inner space to an outside thereof, and wherein the opening formed in the second wall portion is closed by the main wall of the sensor casing in a state in which the sensor device is accommodated in the inner space.

3. The conveying device according to claim 2, wherein the conveyor comprises a conveyor roller located downstream of the second wall portion in the conveying direction and configured to convey the sheet in the conveying direction, wherein the movable member comprises a pivot shaft supported by the sensor casing so as to be pivoted by movement of the sheet contacting the contact portion, and the contact portion and the sensed portion project from an outer circumferential surface of the pivot shaft, wherein, when the sensed portion is located at the first position, the sensed portion projects from the pivot shaft in a direction opposed to a direction directed from the sensed portion to the first wall portion, and wherein, when the sensed portion is moved from the first position to the second position, the sensed portion is moved in the direction directed from the sensed portion to the first wall portion and in a direction directed from the sensed portion to the casing opening.

4. The conveying device according to claim 2, wherein the path defining member comprises a back wall face that defines the inner space and that is provided with one of an engaging protruding portion and an engaging recessed portion, and wherein the sensor casing comprises a face that faces the back wall face and that is provided with one of (i) an engaged recessed portion in which the engaging protruding portion is to be fitted and (ii) an engaged protruding portion on which the engaging recessed portion is to be fitted.

5. The conveying device according to claim 2, wherein an upstream corner portion of the main wall in the conveying direction is covered with the first wall portion in the state in which the sensor device is accommodated in the inner space.

6. The conveying device according to claim 1, wherein the signal output device comprises: a sensor configured to sense the position of the sensed portion; and a sensor circuit board configured to output a signal relating to a result of sensing of the sensor, wherein the movable member comprises a pivot shaft supported by the sensor casing so as to be pivoted by movement of the sheet contacting the contact portion, and the contact portion and the sensed portion project from an outer circumferential surface of the pivot shaft, and wherein the sensor circuit board is located on an opposite side of the pivot shaft of the movable member from the casing opening.

7. The conveying device according to claim 6, wherein the sensor comprises: a light emitter configured to emit light; and a light receiver located in a path of the light emitted by the light emitter, wherein the sensor circuit board is configured to output a signal indicating that the light receiver has received the light, wherein the sensed portion located at the first position is not in the path of the light emitted by the light emitter, and wherein the sensed portion located at the second position is in the path of the light.

8. The conveying device according to claim 7, wherein the contact portion and the sensed portion respectively project in directions that differ from each other, from positions that differ from each other in an axial direction of the pivot shaft, and wherein the sensed portion and the casing opening are located at positions that differ from each other in the axial direction of the pivot shaft.

9. The conveying device according to claim 1, wherein the conveyor comprises:

a first conveyor roller disposed upstream of the first wall portion in the conveying direction to convey the sheet in the conveying direction; and a second conveyor roller disposed downstream of the contact portion of the movable member in the conveying direction to convey the sheet in the conveying direction, and wherein the conveyor further comprises a facing member located between the first conveyor roller and the second conveyor roller in the conveying direction, and the facing member is movable between a covering position where the facing member faces the path defining member and covers the second conveying surface and an exposing position where the facing member exposes the second conveying surface.

10. The conveying device according to claim 1, wherein the conveyor comprises:

a first conveyor roller disposed upstream of the first wall portion in the conveying direction to convey the sheet in the conveying direction; and a second conveyor roller disposed downstream of the contact portion of the movable member in the conveying direction to convey the sheet in the conveying direction, and wherein the conveyor further comprises a cover movable between (i) a covering position where the cover covers a sheet conveying path that is located downstream of the second conveyor roller in the conveying direction and (ii) an exposing position where the cover exposes the sheet conveying path.

11. The conveying device according to claim 10, wherein the conveyor comprises a third conveyor roller located downstream of the second conveyor roller in the conveying direction and configured to convey the sheet in the conveying direction, wherein the cover is configured to cover a portion of the sheet conveying path which is located between the second conveyor roller and the third conveyor roller, and wherein the second conveying surface of the sensor casing is located upstream of the second conveyor roller in the conveying direction.

12. The conveying device according to claim 1, further comprising a supporter that comprises a positioning member capable of supporting a plurality of sizes of sheets and configured to position opposite edges of a sheet in a widthwise direction thereof which is perpendicular to the conveying direction, in a state in which a center of the sheet in the widthwise direction is aligned with a predetermined reference position, wherein the conveyor is configured to convey the sheet supported by the supporter, to the first conveying surface, and wherein the contact portion is disposed at a center of the first conveying surface in the widthwise direction.

13. The conveying device according to claim 1, wherein the guide portion comprises a rib extending in the conveying direction provided on the main wall.

14. An image recording apparatus comprising:

the conveying device according to claim 1;

a recording device disposed downstream of the conveyor in the conveying direction and configured to record an image on the sheet conveyed by the conveyor; and a cover movable between (i) a covering position where the cover covers a sheet conveying path that is opposed to the recording device and (ii) an exposing position where the cover exposes the sheet conveying path.

* * * * *